US008291632B2

(12) United States Patent
Taylor

(10) Patent No.: US 8,291,632 B2
(45) Date of Patent: Oct. 23, 2012

(54) PROJECTILE WEAPONS

(75) Inventor: Hugh Taylor, Great Eversden (GB)

(73) Assignee: Transmission Systems Limited, St. Clement, Jersey (GB)

( * ) Notice: Subject to any disclaimer, the term of this patent is extended or adjusted under 35 U.S.C. 154(b) by 153 days.

(21) Appl. No.: 12/739,664

(22) PCT Filed: Nov. 3, 2008

(86) PCT No.: PCT/GB2008/003694

§ 371 (c)(1), (2), (4) Date: Jul. 9, 2010

(87) PCT Pub. No.: WO2009/056848

PCT Pub. Date: May 7, 2009

(65) Prior Publication Data

US 2010/0307045 A1 Dec. 9, 2010

(30) Foreign Application Priority Data

Mar. 10, 2008 (GB) ..... 0804386.1

(51) Int. Cl.
*F41A 21/00* (2006.01)

(52) U.S. Cl. ..... 42/76.1; 42/76.01; 42/78

(58) Field of Classification Search ..... 42/76.01, 42/76.02, 76.1; 89/14.05, 14.7; 124/83–85; 72/77, 399

See application file for complete search history.

(56) References Cited

U.S. PATENT DOCUMENTS 526,286 A * 9/1894 Bailey et al. ..... 72/341
1,316,509 A * 9/1919 Rose ..... 42/76.1
1,549,051 A * 8/1925 Schreiber ..... 89/192
1,810,342 A * 6/1931 Bulger ..... 72/105
2,371,125 A * 3/1945 Bannister ..... 72/97
2,626,581 A * 1/1953 Almgren et al. ..... 413/27
2,903,929 A * 9/1959 McVey ..... 72/399
2,964,090 A * 12/1960 Raydt et al. ..... 72/77
2,981,155 A * 4/1961 Parlanti ..... 89/16
3,228,298 A 1/1966 Grandy et al.
3,323,339 A * 6/1967 Mattil ..... 72/78

(Continued)

FOREIGN PATENT DOCUMENTS

DE 907385 C 3/1954

(Continued)

OTHER PUBLICATIONS

PCT International Search Report for PCT/GB2008/003694 dated Apr. 7, 2009.

*Primary Examiner* — Bret Hayes
*Assistant Examiner* — Joshua Freeman
(74) *Attorney, Agent, or Firm* — Harry K. Ahn; McCarter & English, LLP

(57) ABSTRACT

A method of making a gun barrel having a breech end and a muzzle end and a bore extending between the two ends comprises applying to the outer surface of the bore a plurality of swaging dies (5), each of which carries an upstanding helical land (10). The dies are pressed simultaneously against the external surface of the gun barrel such that each land forms a helical recess (14) in the external surface and crystalline deformation to the material of the barrel wall immediately below the external helical recess. The distortion of the external surface results simultaneously in the creation of a plurality of smooth helical ridges (16) on the surface of the bore.

6 Claims, 3 Drawing Sheets

U.S. PATENT DOCUMENTS

| | | | | | |
|---|---|---|---|---|---|
| 3,327,039 | A | * | 6/1967 | Ruckert et al. | 264/313 |
| 3,387,477 | A | * | 6/1968 | Shupper | 72/77 |
| 3,572,074 | A | * | 3/1971 | Holdup et al. | 72/77 |
| 3,583,189 | A | * | 6/1971 | Kelstrom | 72/77 |
| 3,672,196 | A | * | 6/1972 | Levacher et al. | 72/77 |
| 3,673,916 | A | * | 7/1972 | Wittholz | 89/1.816 |
| 3,732,717 | A | * | 5/1973 | Ahlvers | 72/77 |
| 3,738,044 | A | | 6/1973 | Robinson | |
| 3,780,465 | A | | 12/1973 | Polcha | |
| 3,788,113 | A | * | 1/1974 | Martin | 72/77 |
| 3,893,321 | A | * | 7/1975 | Braunwieser | 72/76 |
| 4,043,161 | A | * | 8/1977 | Toma et al. | 72/78 |
| 4,435,968 | A | * | 3/1984 | Roderburg | 72/77 |
| 5,435,089 | A | * | 7/1995 | Rodney, Jr. | 42/51 |
| 5,448,848 | A | * | 9/1995 | Moller | 42/77 |
| 6,324,780 | B1 | | 12/2001 | Behling | |
| 6,826,940 | B2 | * | 12/2004 | Utyashev et al. | 72/100 |
| 7,934,332 | B2 | * | 5/2011 | Briggs | 42/76.02 |
| 8,025,003 | B1 | * | 9/2011 | Saur | 89/14.05 |
| 8,037,877 | B2 | * | 10/2011 | Liao | 124/44.7 |
| 2007/0209646 | A1 | * | 9/2007 | Siebelink | 124/17 |

FOREIGN PATENT DOCUMENTS

| | | | |
|---|---|---|---|
| EP | 0892238 | A | 1/1999 |

* cited by examiner

PROJECTILE WEAPONS

CROSS REFERENCE TO RELATED APPLICATIONS

This application is a national phase of PCT application No. PCT/GB2008/003694, filed Nov. 3, 2008, which claims priority to GB patent applications No. 0721534.6, filed Nov. 2, 2007, and No. 0804386.1, filed Mar. 10, 2008, all of which are incorporated herein by reference.

The invention relates to projectile weapons. More particularly, the invention relates to a method for the manufacture of gun barrels and to gun barrels made by the method.

It has long been known to provide so-called "rifling", that is a series of helical projections in the bore of a gun barrel to impart spin to the projectile during its passage along the barrel and thus to improve the accuracy of the gun. These helical projections can be created by several alternative precision manufacturing processes, such as "single point cut rifling", "broached rifling", "button (or pressed) rifling", or "hammer forged rifling". The hammer forging process involves placing a precisely shaped mandrel containing a reverse impression of the desired rifling, inside the carefully prepared barrel tube and hammer forging the outside of the barrel. Hammer forging is also used to produce "polygonal" rifling, in which the helical projections are replaced by a near-regular polygonal pattern.

All these processes disturb the inside surface of the barrel to a greater or lesser degree, which disturbance often requires further extensive honing and polishing before the barrel can be used.

All these rifling processes are relatively expensive, because they generally require expensive plant and/or tools and frequently also highly-skilled operators and substantial time.

In low power guns such as so-called "air" guns, i.e. both rifles and pistols, which are powered by a compressed gas, such as air or carbon dioxide (CO2), conventional rifling tends to result in the significant escape of air or other compressed gas past the projectile or pellet, resulting in a lowering of efficiency. To this extent at least, a smooth bore air gun, that is a gun without rifling in its barrel, is more efficient in its use of the motive compressed gas since there can be a better seal between the skirt of the air gun pellet and the bore of the barrel, which results in higher speed of the pellet.

The same problem is present to a greater or lesser degree in cartridge firearms.

In addition, all projectiles travelling through conventional rifled barrels are forced to engage the rifling, usually very soon after starting to move. This process, which can be equated to an extrusion process, consumes relatively significant amounts of energy, thus increasing the resistance to movement arising from inertia and friction. Once the rifling has been engaged, this particular element of resistance will greatly decrease. Unfortunately, particularly in high-velocity cartridge firearms, this additional resistance arises precisely as the very high pressures being generated by the burning propellant powder rapidly reach a peak, or pressure spike. If the movement of the projectile is slowed at this point, even very briefly, the pressure spike can reach damaging levels.

It is an object of the present invention to mitigate these problems while maintaining or improving the accuracy of the weapon.

It is a further object of the invention to provide a method of making a gun barrel in a simple and cost-effective manner which will impart spin to a projectile without resorting to conventional rifling.

According to the present invention, a method of making a gun barrel having a breech end and a muzzle end and a bore extending between the breech and muzzle ends comprises applying pressure to the external surface of at least a portion of the length of the barrel to form a plurality of helical recesses in the external surface and thus also a plurality of helical ridges on the surface of the bore.

The radial twist rate of the rifling in conventional air weapons is often of the order of five and one half or six degrees, that is a twist of one in fifteen or one in sixteen inches (380 to 400 mm). This twist rate has been adopted for the air weapon development programme for the subject invention and the results have been very satisfactory. Nevertheless, further testing with different twist rates may improve matters even further.

The external pressure may be applied by a process known as swaging, which is conventionally used to form the choke portion of an air weapon barrel, as described below. In the preferred embodiment, the pressure is applied to the external surface of the gun barrel by means of a plurality of swaging dies, each of which carries an upstanding helical land and the method includes pressing the dies simultaneously against the external surface of the gun barrel such that each upstanding land forms a helical recess in the external surface. It will be appreciated that, in forming recesses in the outer surface, the swaging process will deform helical portions of the barrel inwards to form smooth, shallow, helical ridges on the inner surface of the barrel. These ridges will project radially into the bore for a small distance, measured in fractions of a millimeter or a few thousandths of an inch, preferably less than 0.25 mm, and more likely of the order of 0.1 mm, in the case of an air weapon of 0.22 inch (5.5 mm) calibre. It will also be appreciated that although the recesses in the external surface may be sharp-sided with abrupt changes in radius of curvature, the force dissipating effect of the material of the barrel will result in the profile of the ridges on the surface of the bore being smoothly curved, as distinguished from the sharp castellations of conventional rifling. Since the deforming pressure is applied externally and does not involve internally machining the bore, the bore remains smooth in profile after it has been deformed to produce the ridges and thus does not require subsequent honing or other machining or processing and is thus instantly ready for use. The ridges are, however, effective to impart spin to a projectile, such as an air gun pellet.

Astonishingly, it is found that accuracy equal or superior to that obtainable from a conventional rifled barrel can be achieved. In multiple comparative tests, barrels made according to the invention have produced accuracy results superior to conventional barrels, when fitted to the same air-rifle. Even more extraordinary, it has been established that barrels made according to the invention are extraordinarily tolerant of air gun projectile size and consistency.

It has long been known that high-quality conventional air gun barrels tend only to achieve their best accuracy with very high quality, consistent projectiles of a particular diameter. In consequence, for many years all "match-quality" air gun projectiles have been available in range of sizes, typically varying by 0.01 mm in any given nominal calibre. Thus it is normal for match quality air gun projectiles in a nominal calibre of 4.5 mm to be available in, say, 4.48, 4.49, 4.50, and 4.51 mm. A serious competitor will test various brands and sizes in their particular air gun, select the one that seems to produce the best results and use that from then on.

With a high-quality conventional barrel, the variation in accuracy, i.e. consistency, with different brands and sizes of projectiles is often very marked indeed. In other words the size of the group of holes made in a target by successive shots can and does usually increase or decrease significantly, even with the same barrel, depending on the size and consistency of the projectiles used.

By contrast, barrels made according to the invention have proved to be amazingly tolerant of projectile quality, size and consistency. Many tests have demonstrated that barrels made according to the invention can produce very small groups with a wide range of projectiles, including projectiles that produce very poor groups in conventional barrels.

Whilst the reason for the enhanced accuracy is not fully understood, it is believed that the relatively sharp edges of conventional rifling result in microscopically asymmetric deformation of the projectile. The high speed with which the projectile is caused to spin by the rifling means that this minor asymmetry of the projectile results in irregular and unpredictable motion of the projectile through the air which in turn results in a scatter pattern in the positioning of successive projectiles. By contrast, the very smooth curved shape of the helical ridges produced by the method of the present invention produces no asymmetrical deformation of the projectile which can thus fly straighter and more predictably through the air.

It is also thought likely that the typical projectile for air guns, a diabolo or waisted pellet with a hollow base and relatively flexible skirt, will expand better to fit the smooth bore of a barrel made according to the invention, prior to engaging the helical ridges. It is thought that this precise "fitting" process is likely to be a major factor in enabling projectiles of varying sizes and consistency to perform so well in any given barrel made according to the invention.

It is anticipated that a similar effect will likely be achieved with cartridge firearms using barrels made according to the invention, especially when used with projectiles with hollow bases which are designed to expand into the bore under the influence of the pressure of the burning propellant.

It is preferred that each helical land has an engagement surface which engages the external surface of the gun barrel and the engagement surface is of part-cylindrical shape and the method includes pressing the dies into the external surface of the gun barrel to form the helical recesses until all the engagement surfaces are concentric.

It is also preferred that the end portion of each helical land closest to the breech end of the gun barrel is of progressively decreasing width and preferably also height towards the breech end. This feature will further enhance the smoothness with which the breech end of the ridges will merge into the surface of the bore.

It is preferred that the helical ridges are formed only on the muzzle end portion of the gun barrel. In one embodiment, the swaging dies are applied to the external surface of the gun barrel to form a first plurality of helical recesses and are then moved outwardly and then in rotation relative to the gun barrel and are then applied again to the external surface to form a second plurality of helical recesses offset from the first plurality in the direction of the circumference of the gun barrel. Alternatively or additionally, the swaging dies may be applied to the external surface to form a further plurality of helical recesses offset from the first plurality in the direction of the length of the gun barrel.

As mentioned above, the ridges which are formed by the method of the present invention are inherently smoothly arcuate and merge smoothly into the surface of the bore. Such a profile of the rifling is unusual in its own right and thus according to a further aspect of the present invention there is provided a barrel for a projectile weapon comprising an elongate hollow cylindrical metallic member defining an internal longitudinal cylindrical passage, formed in at least a proportion of whose external surface is a plurality of elongate helical grooves, opposed to which on the internal surface of the metallic member are respective elongate helical ridges, each ridge having a shape in transverse cross-section which is smoothly arcuate and merges smoothly into the said internal surface with a progressive change in the radius of curvature. In practice, the breech end of each helical ridge will have a shape in longitudinal cross-section which is smoothly arcuate and merges smoothly into the said internal surface with a progressive change in the radius of curvature.

This internal cross-section is similar to that of the "Metford" grooving for the British 0.303 rifle of the 1860's. The Metford grooving was created by careful and precise internal machining processes throughout the length of the barrel, without leaving any corresponding indentations of any sort on the external surface.

For many years it has been common practice for high-quality air-rifle manufacturers to try and improve accuracy by slightly squeezing or swaging the muzzle end of the barrel in a process known as "choking", which very slightly reduces the internal diameter of the bore at that point. The improved relative performance of barrels produced by the invention, as described above, includes comparisons against conventional, high-quality, choked barrels.

Thus the application of the invention can be arranged to simultaneously provide a choking effect, thus offering the opportunity to eliminate the need for this to be obtained by means of a further manufacturing step. This can be achieved by ensuring that the height of the lands on the swaging tools is such that when the grooves in the outer surface of the barrel reach the required depth, the remainder of the inner surface of the swaging tools is in engagement with the outer surface of the barrel. Further pressure may then be applied to the swaging tools to compress the barrel slightly, thereby slightly reducing the diameter of, or choking, the barrel. This will result in the diameter of the bore, as measured at the valleys between the internal elongate helical ridges being less than the diameter of the unswaged bore, e.g. by an amount of the order of 0.001 inches (0.025 mm) to 0.002 inches (0.050 mm) in the case of an airgun.

As described, the method of the invention does not involve any cutting into the surface of the internal bore of the barrel, nor any impact between the internal bore surface and a hard object, such as the mandrel required in the hammer forging process. This leaves the bore surface in the same condition that it was prior to the performance of the method of the invention, whether that internal surface condition has been achieved by deep-hole drilling, boring, cold-drawing or any other method or combination of such methods, possibly followed by a polishing process such as honing. It is believed that this smooth, undamaged surface finish also contributes to the enhanced velocity that has been observed when firing identical projectiles through both a conventional barrel and a barrel made by the method of the invention, when fitted alternately to the same air-rifle.

It is believed that this smoothness and consequent reduced friction and heat generation are very likely to significantly enhance barrel durability in general, perhaps especially so with high-velocity cartridge firearms. This is likely to be of particular value in military applications offering fully automatic fire capability. In these applications, barrel wear is a significant operational problem.

The method may comprise the step of subsequently removing external evidence of the swaging, e.g. by turning the swaged portion of the barrel in a lathe or by grinding. Alternatively, the swaged barrel may be shrouded by an external cover or the external swaging marks may be covered by a sound moderator fixed to the muzzle end of the barrel.

The rifling in conventional firearms starts at or very close to the breech end of the muzzle but it is preferred that, in a gun barrel in accordance with the invention, it is provided only at the muzzle end of the barrel. This results in an increased velocity of the projectile because it is in contact with the smooth, unrifled surface of the bore for the initial portion of its movement along the barrel. Providing conventional rifling only at the muzzle end of the bore was used in the Fosbery Paradox shotgun of the 1880's and subsequently but requires a high order of internal precision machining of the bore of the barrel, resulting in similar or even greater manufacturing costs than conventional rifling throughout the bore.

It is believed that the accuracy and consistency achieved by the present invention are partly due to the smooth and gentle manner in which the breech end of the ridges merges into the surface of the bore which results in the projectile being "funnelled" smoothly into the rifled portion of the bore without having instability imparted to it or it being asymmetrically deformed, as occurs with conventional rifling due to its relatively sharp edges.

It also seems likely that the smooth external surface of a projectile that has passed through a barrel made in accordance with the invention will be less likely to be affected by lateral wind currents than a projectile with a series of relatively sharp indentations, as is caused by many types of conventional rifling.

The present invention also embraces projectile weapons incorporating barrels made in accordance with the method of the invention.

Further features and details of the invention will be apparent from the following description of one specific embodiment, which is given by way of example, with reference to the accompanying drawings, in which.

Figure 1:
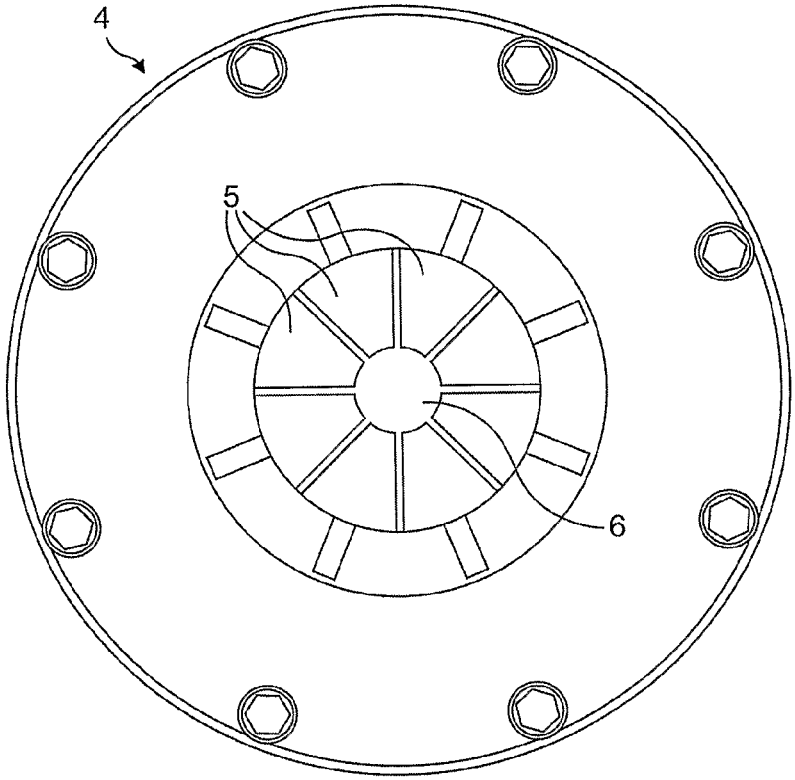
FIG. 1 is a front view of a swaging machine having eight segmental tools which together define a cylindrical aperture which can be reduced in diameter to swage or crimp a barrel located in the aperture.

FIG. 1 shows a known swaging or crimping machine 4 comprising a set of eight identical segmental swaging tools 5 which together define a cylindrical aperture 6 and which can be moved radially inwards under power to crimp or swage a workpiece (not shown in FIG. 1) held in the aperture 6. In the present case, the workpiece is a gun barrel 7, as shown in FIG. 4, more particularly the muzzle end 8 of the gun barrel 7.

Figure 2:
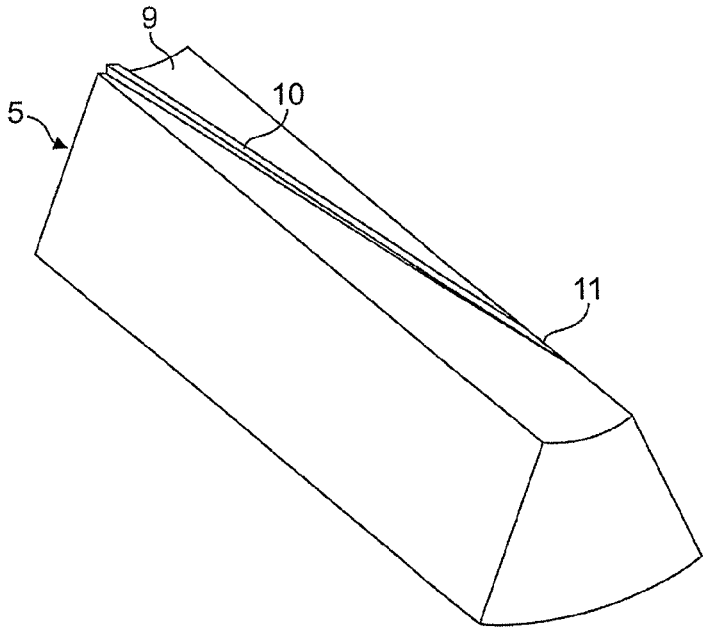
FIG. 2 is a perspective view of one of the segmental tools of the swaging machine shown in FIG. 1.
Figure 3:
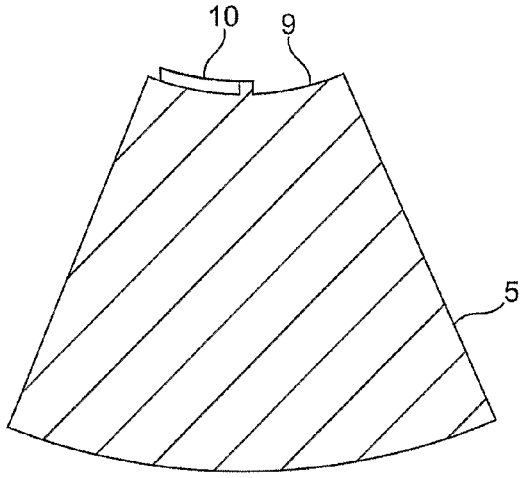
FIG. 3 is a transverse sectional view of the segmental tool shown in FIG. 2.

FIG. 2 shows one of the segmental swaging tools 5 and, as can be seen, the inner working face 9 of the tool is formed with a raised rib or land 10 which has a helical profile. The working face 9 is of part-cylindrical shape with a radius substantially equal to the external radius of the gun barrel. The inner working surface of the land 10 is also of part-cylindrical shape, though with a radius which is preferably very slightly smaller than that of the surface 9. In this case the land 10 is of generally rectangular shape. The width of the land 10 is also constant over most of its length but it will be seen that at the breech end it meets the side surface of the tool and from that point the breech end portion 11 of the land is of decreasing width.

In use, the muzzle end only of the gun barrel is inserted into the central aperture 6 of the swaging machine shown in FIG. 1. The swaging tools 5 are then forced inwardly against the outer surface of the barrel to create a plurality of helical grooves in the outer surface. In production this inward movement is terminated automatically by an adjustable control mechanism at the point where experimentation has shown that the desired defomation on the inside of the barrel will have taken place. At this point the part-cylindrical working surfaces of the lands 10 are coaxial with one another and with the barrel.

Figure 4:
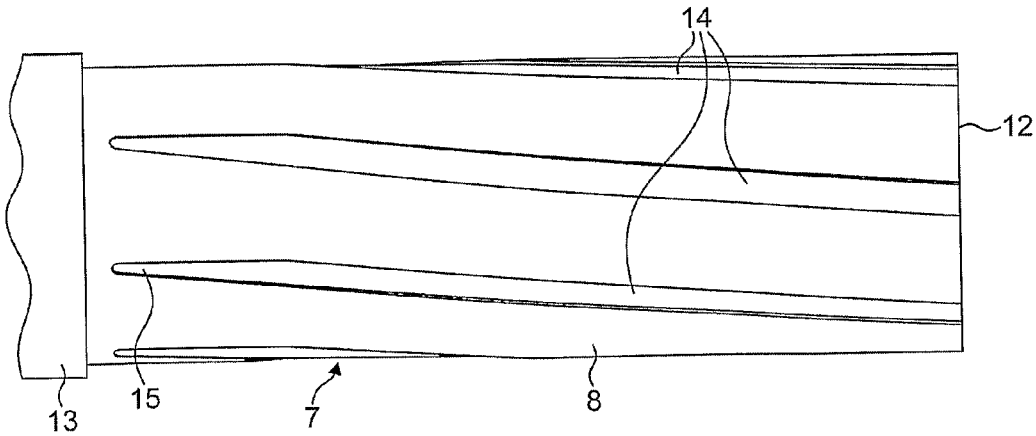
FIG. 4 shows the muzzle end of a gun barrel that has been formed in accordance with the present invention.

The grooves 14 formed in the outer surfaces of the barrel are shown in FIG. 4. Those shown are of substantially rectangular section with a part-cylindrical base matching the part-cylindrical working surfaces of the lands. The grooves 14 are of constant width over most of their length but at their breech end have a portion 15 of progressively decreasing width corresponding to the portions 11 of decreasing width of the lands 10. The production of the helical grooves 14 in the outer surface of the barrel results in deformation and refinement of the crystalline structure of the metal of the barrel wall immediately below each groove and in the production of helical ridges on the surface of the bore within it but, as a result of the force diffusing effect of the wall of the barrel, these internal ridges inherently have a shape in transverse cross-section which is smoothly arcuate and merges smoothly into the internal surface of the barrel with a smooth or progressive change in the radius of curvature. The shape of the breech end of the internal helical ridges is of similar smoothly arcuate shape in longitudinal cross-section and merges smoothly into the internal surface of the barrel with a progressive change in the radius of curvature. This smooth, progressive merging of the breech end of the ridges into the internal surface of the barrel may be further enhanced by making the portion 11 of the lands 10 of progressively decreasing height.

Figure 5:
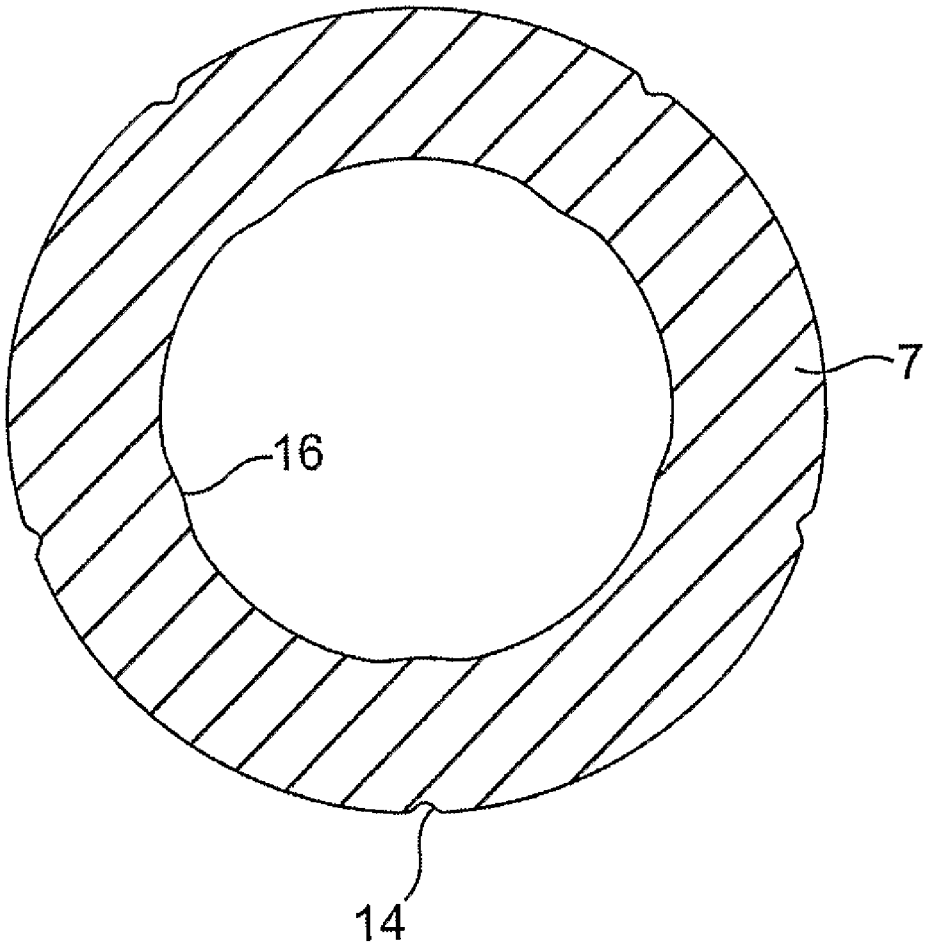
FIG. 5 is a magnified transverse sectional view, not to scale, of a rifle barrel produced by a slightly modified method in accordance with the invention.

In the method described above, the lands 10 are of substantially rectangular cross-sectional shape but a variety of different shapes may be used. It may well be that a broadly semi-circular, U-shaped, rounded V-shaped, or similar cross-section without sharp edges, will prove to be best-suited to long production runs. In one modified form of the method, the lands 10 are of rounded V cross-sectional shape. FIG. 5 is a cross-sectional view of a rifle barrel made by this method and it may be seen that in this case the grooves 14 are of generally rounded V shape. It will be appreciated that the height of the ridges 16 on the interior surface of the barrel is only a fraction of a millimeter above the level of the valleys 17 and that this has therefore been exaggerated in FIG. 5 to render the ridges more clearly visible.

Although all the helical ridges on the internal surface of the barrel may be produced in a single swaging process, it is also possible to produce them in two or more swaging processes. Thus once the initial swaging process has been completed, it is possible to rotate the barrel within the swaging machine and then to swage the barrel again to produce a further set of helical ridges, preferably mid-way in the circumferential direction between the ridges produced in the first swaging process. Alternatively or additionally, it is possible to move the barrel axially after the first or second swaging process and then to perform a further swaging process to produce a further set of helical ridges which are axially offset from the ridges previously produced.

It has been found that the swaging process of the invention can produce the necessary degree of choking to the muzzle end of the bore of the barrel without the need for any additional machining step.

The invention provides a significantly cheaper alternative to conventional rifling in a gun barrel which, in relatively low-powered guns such as so-called air guns, has proved to provide enhanced accuracy, very greatly increased tolerance to projectile variations and improved efficiency by reducing leakage of the propellant gas past the projectile. It is believed that the same benefits will also be obtained with cartridge firearms.

The invention claimed is:

1. A method of making a gun barrel having a breech end and a muzzle end and a bore extending between the breech and muzzle ends comprising applying pressure to an external surface of at least a portion of the length of the gun barrel to form a plurality of helical recesses in the external surface and thus also a plurality of helical ridges on the surface of the bore, wherein pressure is applied to the external surface of the gun barrel by a plurality of swaging dies, each of which carries an upstanding helical land and the method includes pressing the dies simultaneously against the external surface of the gun barrel such that each upstanding land forms a helical recess in the external surface.

2. A method as claimed in claim 1 in which each helical land has an engagement surface which engages the external surface of the gun barrel and the engagement surface is of part-cylindrical shape and the method includes pressing the dies so that the lands deform the external surface of the gun barrel to form the helical recesses until all the engagement surfaces are concentric.

3. A method as claimed in claim 1 in which an end portion of each helical land closest to the breech end of the gun barrel is of progressively decreasing width towards the breech end.

4. A method as claimed in claim 1 in which the helical recesses and ridges are formed only on the muzzle end portion of the gun barrel.

5. A method as claimed in claim 1 in which the swaging dies are applied to the external surface of the gun barrel to form a first plurality of helical recesses and are then moved outwardly and then in rotation relative to the gun barrel and are then applied again to the external surface to form a second plurality of helical recesses offset from the first plurality in the direction of the circumference of the gun barrel.

6. A method as claimed in claim 1 in which the swaging dies are applied to the external surface of the gun barrel to form a first plurality of helical recesses and are then moved outwardly and then longitudinally relative to the gun barrel and are then applied again to the external surface to form a further plurality of helical recesses offset from the first plurality in the direction of the length of the gun barrel.

* * * * *